US006772893B2

(12) United States Patent
Parés Montaner et al.

(10) Patent No.: US 6,772,893 B2
(45) Date of Patent: Aug. 10, 2004

(54) CAP FOR BOTTLE STOPPING DEVICE

(75) Inventors: Pere Parés Montaner, Llobregat (ES); Santiago Julian Pidevall, Llobregat (ES)

(73) Assignee: Saint-Gobain Calmar, S.A., Barcelona (ES)

( * ) Notice: Subject to any disclaimer, the term of this patent is extended or adjusted under 35 U.S.C. 154(b) by 17 days.

(21) Appl. No.: 10/240,216

(22) PCT Filed: Sep. 26, 2001

(86) PCT No.: PCT/ES01/00356

§ 371 (c)(1),
(2), (4) Date: Sep. 30, 2002

(87) PCT Pub. No.: WO02/068285

PCT Pub. Date: Sep. 6, 2002

(65) Prior Publication Data

US 2003/0102282 A1 Jun. 5, 2003

(30) Foreign Application Priority Data

Feb. 28, 2001 (ES) ..... 200100471

(51) Int. Cl.[7] ..... B65D 45/34
(52) U.S. Cl. ..... 215/274; 222/321.1

(58) Field of Search ..... 215/274, 247, 215/275, 280, 289, 292, 298, 252, 328; 222/321.1–321.9

(56) References Cited

U.S. PATENT DOCUMENTS

| | | | | | |
|---|---|---|---|---|---|
| 3,112,048 | A | * | 11/1963 | Finkenzeller | 222/183 |
| 5,299,703 | A | * | 4/1994 | Cater | 215/274 |
| 5,692,650 | A | * | 12/1997 | Wolter et al. | 222/321.9 |
| 5,875,906 | A | * | 3/1999 | Price et al. | 215/252 |
| 5,957,313 | A | * | 9/1999 | Bouan | 215/215 |
| 5,992,660 | A | * | 11/1999 | Miura et al. | 215/247 |
| 6,341,706 | B1 | * | 1/2002 | Neuner | 215/40 |
| 6,364,181 | B1 | * | 4/2002 | Garcia et al. | 222/634 |
| 6,595,395 | B2 | * | 7/2003 | Jourdin et al. | 222/321.9 |

* cited by examiner

*Primary Examiner*—Lien Ngo
(74) *Attorney, Agent, or Firm*—Staas & Halsey LLP

(57) ABSTRACT

A cap for a bottle stopping device to be mounted on a main body member. The main body member has retaining tabs, and the cap has a side wall for pressing the tabs against the bottle neck. The side wall has an upper portion, and a lower portion provided with an end portion folded back 180° over itself towards the inside, in such a way as to define an internal shoulder for retaining the tabs.

5 Claims, 2 Drawing Sheets

CAP FOR BOTTLE STOPPING DEVICE

BACKGROUND OF THE INVENTION

1. Field of the Invention

The invention relates to a cap for a bottle-stopping device, where the device comprises a main body member and the cap, and where the cap is mounted on the main body member, the main body member being provided with retaining tabs, so that the cap presses the tabs against the bottle neck by means of a side wall. This side wall has an upper portion and a lower portion.

2. Description of the Related Art

Bottle stoppers are known that are effected by means of a ferrule of metallic material. They are used to stopper all kinds of bottles or flasks having a neck provided with an outer annular rim in the upper edge of the neck. The top of the outer annular rim is usually flat and flush with the upper edge of the neck and the lower portion thereof is attached to the outer side surface of the neck at an intermediate point thereof. The ferrule is a metallic member that usually comprises a flat annular portion, and a cylindrical portion, attached to the flat annular portion at an outer end thereof and perpendicular to said flat annular portion. When the ferrule is mounted on the bottle or flask, the flat annular portion bears on the outer annular rim, or on an elastic ring whose function is to improve the tightness of the stopper and which is deposited, in this case, on the outer annular rim. In any case, the flat annular portion is substantially parallel to the upper end of the outer annular rim. The cylindrical portion then surrounds the outer annular rim on the outside thereof. It is then necessary to carry out an operation pressing said cylindrical portion against the outer annular rim, deforming it and thereby attaching the ferrule to the bottle.

This process has a number of drawbacks, one of which is the cost thereof, both of the materials used and of the operations required for carrying out the stopping of a bottle.

There are also bottle stopping devices that comprise a main body member of plastics material with a annular portion to be mounted parallel to the upper edge of the neck, tabs directed downwardly from the outer edge of the annular portion, and a substantially cylindrical jacket or cap, adapted for sliding over the tabs. Each tab is provided with a projection that, when the jacket is placed over the tabs, is positioned exactly under the outer annular rim.

In the patent application ES P9900578 and in the application of patent of addition ES P200000557 that are incorporated herein by reference, examples of bottle stopper devices are described. The caps of the prior art devices are usually mounted on the main body member with a force sufficient to bend the tabs and press them tightly against the bottle neck. In this way the cap is fixed on the main body member by the frictional force existing between the cap and the tabs. However, in certain cases, this frictional force is insufficient, and it is possible to remove the cap again and consequently, to disassemble the main body member. It is therefore desirable to endow the bottle stopper device with a mechanism preventing removal of the cap, once mounted, or at least making removal very difficult.

In this sense, it is possible to endow the cap with internal protuberances that increase the frictional force between the cap and the main body member, such as for example in the caps described in the document EP 0 704 251 A.

In other cases, a snap-fit mechanism is included in the bottle stopper device, in the form of a shoulder provided inside the cap against which the tabs are retained.

However, these solutions have aesthetic effects that can be undesired and/or have reduced effectiveness.

Another drawback of the known caps is that the lower end thereof is usually a sharp edge. This sharp edge can cause cuts in the personnel and can hinder the sliding movement of the caps when mechanical means are used. This obliges this sharp edge to be rounded.

SUMMARY OF THE INVENTION

It is an object of the invention to overcome these drawbacks simply and simultaneously, with a reduced economic cost. This aim is achieved by a cap for a bottle stopping device of the type first mentioned above wherein said side wall at said lower portion is provided with an end portion folded back 180° over itself toward the inside, in such a way as to define an inner shoulder for retaining said tabs.

Indeed, in this way, all the previously mentioned drawbacks are simultaneously solved by a single bending operation. An excellent hold is achieved, since the snap-fit is stronger than a simple frictional hold. A rounded lower edge of the cap is achieved which is, therefore, appropriate for manipulation and for sliding movement. The fold is internal, whereby it is invisible from the outside and it does not affect the aesthetic aspect. Additionally, the rounded lower end facilitates the operation of mounting the cap on the main body member.

The side wall is preferably thinner at said lower portion than at said upper portion. In this way the height of the shoulder can be lower than in the case where the wall is of constant thickness. In this way the snap-fit properties can be better combined with the force required for mounting the cap on the main body member that, with a shoulder of great height, would require an excessively high force, and could even damage the main body member. In particular, the optimum height ranges between 0.05 and 0.40 mm.

One particularly advantageous embodiment of the invention is obtained when the cap is provided with a recess adjacent said shoulder. Indeed, the cap presses and resiliently and plastically deforms the main body member. With the existence of a recess, the main body member (precisely the ends of the tabs) can expand slightly outwardly, partially occupying the recess. In this way the interference height between the main body member and the cap is greater than simply the height of the shoulder, since the distance that the ends of the tabs have expanded toward the recess is added thereto. This recess is preferably obtained by a side wall having two thicknesses, a first thickness at the upper portion and a second thickness at the lower portion, so that the recess is formed by leaving a free space between the upper portion and the folded free end of the lower portion.

Another particularly advantageous embodiment of the invention is obtained when the side wall is provided with three differentiated thicknesses: a first thickness at the upper portion, a second thickness at an intermediate side wall portion of the lower portion that is adjacent the upper portion, the second thickness being smaller that the first thickness, and a third thickness at the side wall end portion folded back towards the inside, said third thickness being smaller than said second thickness. In this way, the third thickness makes it easier to fold the end portion of the cap back towards the inside.

BRIEF DESCRIPTION OF THE DRAWINGS

Further advantages and characteristics of the invention will be appreciated from the following description, wherein, without any limitative character, embodiments of the invention are related, with reference to the accompanying drawings, in which.

DESCRIPTION OF THE EMBODIMENTS

Figure 1:
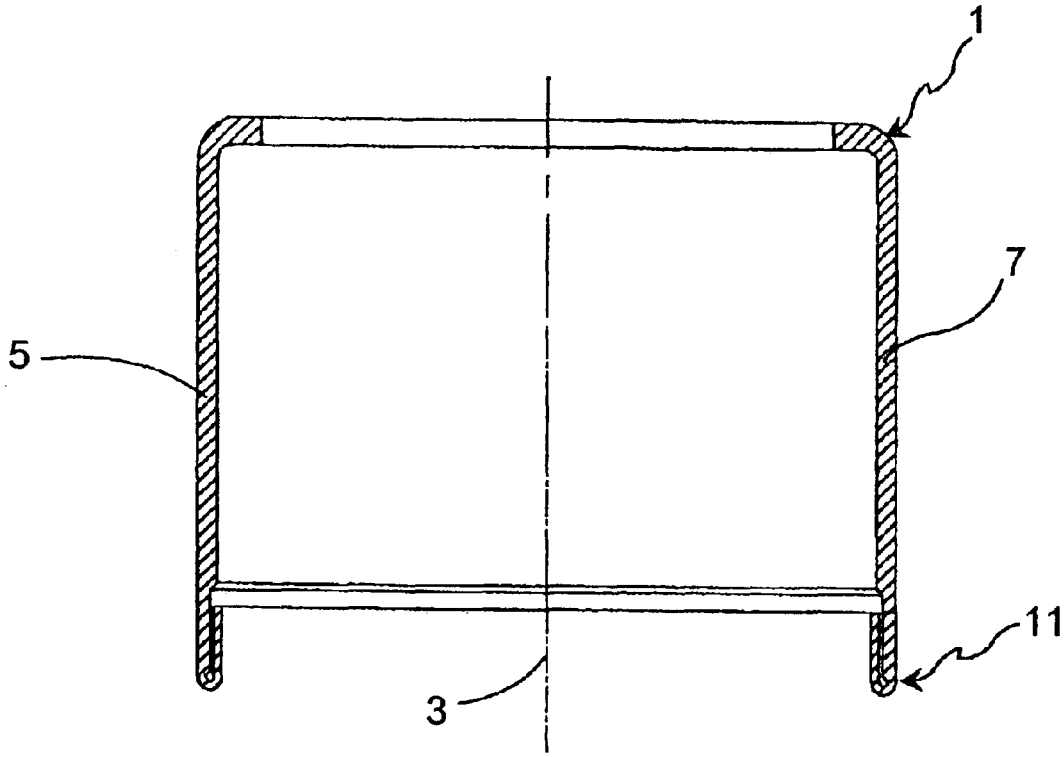
FIG. 1 is a cross section view of a cap according to the invention.
Figure 2:
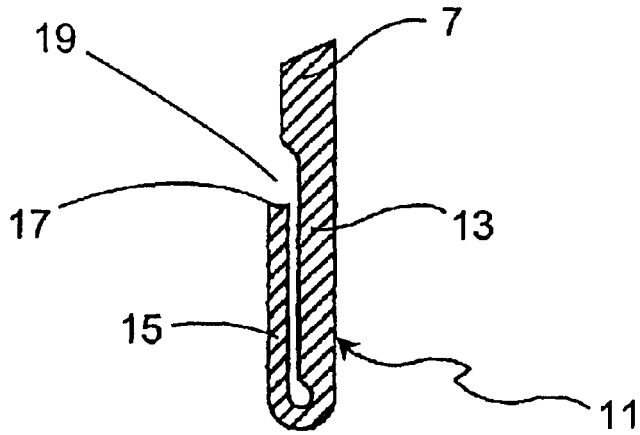
FIG. 2 is an enlarged view of the lower portion of the cap of FIG. 1.

The cap 1 shown in FIG. 1 is substantially a circular cylindrical metallic sleeve defining a longitudinal axis 3, and having a side wall 5. The side wall 5 has an upper portion 7, of constant thickness, the upper end of which is bent 90° inwardly, that is to say, towards the longitudinal axis 3, so that an annular surface is formed extending radially towards the longitudinal axis 3. This annular surface is the one that will draw the main body member 9 with it during the assembly operation, and that will press the main body member 9 axially against the bottle neck.

This geometry is very habitual, however it is not indispensable for the present invention. The present invention can be embodied in caps of very diverse geometries, cylindrical (circular, elliptical or irregular), conical of any type, even in the form of a spherical or ellipsoidal cap, and even in other completely irregular forms, provided that they have a side wall that should press tabs against a bottle neck, and whenever it is desirable that they have a device preventing them from coming out of the assembled position thereof.

The side wall 5 is provided with a lower portion 11 where there is to be observed an intermediate portion 13 of side wall 5 adjacent the upper portion 7, but which is provided with a second thickness smaller than the thickness (or first thickness) of the upper portion 7. The side wall 5 is then folded 180° back over itself towards the inside of the sleeve, so that the end portion 15 of the side wall 5 is folded back over the intermediate portion 13. The end portion 15 has a third thickness that is smaller than the second thickness. The end portion 15 is shorter (measured in the axial direction) than the intermediate portion 13. In this way there is no complete overlap of both portions but rather there is a free space between the free end 17 of the end portion 15 and the end of the upper portion 7 (which is where the first reduction of thickness occurs, when passing from the first thickness to the second thickness). This free space defines a recess 19.

In the example shown in the Figures, the internal diameter of the upper portion 7 is 16.86 mm and the internal diameter of the folded end portion 15 is 16.6 mm. In this way there is defined a shoulder between the upper portion 7 and the lower portion 11. In the example of the Figures the height of the shoulder is 0.13 mm, heights of between 0.08 mm and 0.33 mm being adequate. All these dimensions should be understood strictly by way of example.

Figure 3:
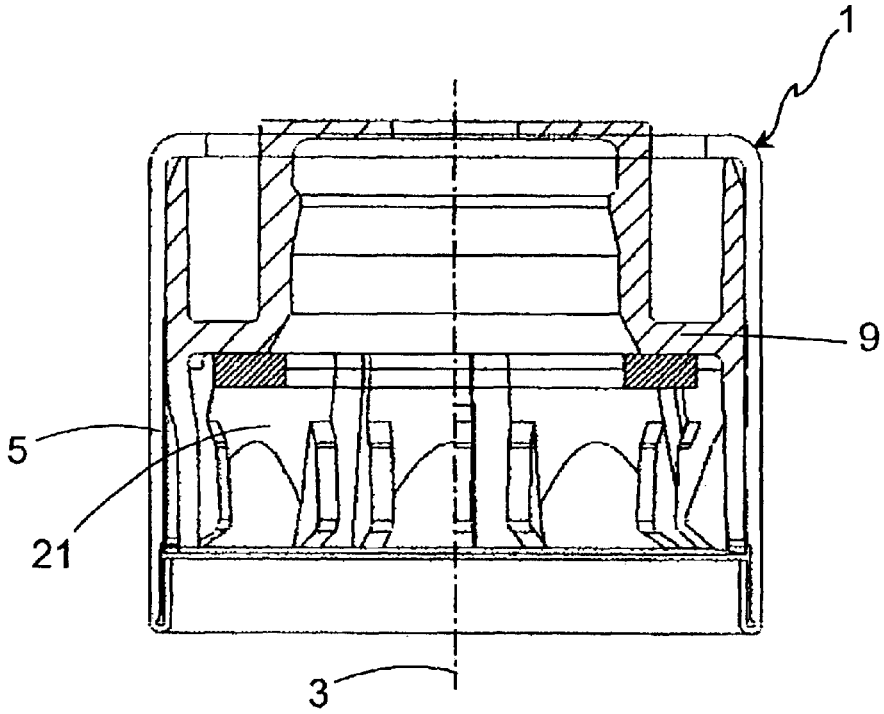
FIG. 3 is a cross section view of an assembled cap and main body member.
Figure 4:
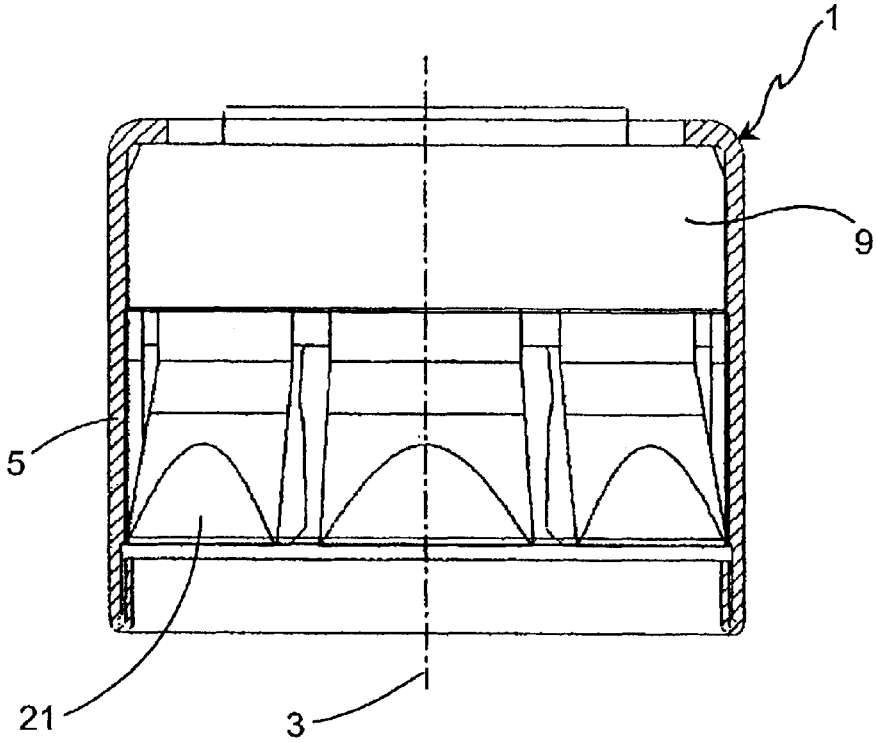
FIG. 4 is a view similar to FIG. 3, but in which the main body member has been illustrated not sectioned.

FIGS. 3 and 4 show a main body member 9 on which the cap 1 of FIG. 1 has been mounted. For simplicity the bottle neck has not been shown. The main body member 9 is provided with tabs 21 that are pressed by the cap 1 against the bottle neck. The way these devices are assembled and the grip effected by the tabs 21 are known to one skilled in the art, wherefor no greater details are given. By way of example, the operation and assembly of examples of these devices are described in the above-mentioned documents ES P9900578 and ES P200000557.

It can be observed that the interference height between the tabs 21 and the end portion 15 is larger than the shoulder (defined as the difference between the radius of the upper portion 7 and the radius of the end portion 15) since the tabs 21 have been inserted to some extent in the recess 19.

What is claimed is:

1. A cap for a bottle stopping device, said device comprising a main body member and said cap, said cap being adapted to be mounted on said main body member and thereby defining a mounted position, said main body member having retaining tabs, said cap having a side wall for pressing said tabs against a neck of a bottle in said mounted position, said side wall having an upper portion and a lower portion, wherein said side wall is provided at said lower portion with an end portion folded back 180° over itself towards the inside, to define an internal shoulder for retaining said tabs, and wherein said side wall is provided with three differentiated thickness: a first thickness at said upper portion, a second thickness at an intermediate portion of said side wall of said lower portion adjacent said upper portion, the second thickness being smaller than the first thickness, a third thickness at said end portion of said side wall folded back towards the inside, said third thickness being smaller than said second thickness.

2. A cap for a bottle stopping device, said device comprising a main body member and said cap, said cap being adapted to be mounted on said main body member and thereby defining a mounted position, said main body member having retaining tabs, said cap having a side wall for pressing said tabs against a neck of a bottle in said mounted position, said side wall having an upper portion and a lower portion, wherein said side wall is provided at said lower portion with an end portion folded back over itself towards the inside, to define an internal shoulder for retaining said tabs, wherein said side wall is provided with a smaller thickness at said lower portion than at said upper portion, and wherein said side wall is provided with three differentiated thicknesses: a first thickness at said upper portion, a second thickness at an intermediate portion of said side wall of said lower portion adjacent said upper portion, the second thickness being smaller than the first thickness, a third thickness at said end portion of said side wall folded back towards the inside, said third thickness being smaller than said second thickness.

3. A cap for a bottle stooping device, said device comprising a main body member and said cap, said cap being adapted to be mounted on said main body member and thereby defining a mounted position, said main body member having retaining tabs, said cap having a side wall for pressing said tabs against a neck of a bottle in said mounted position, said side wall having an upper portion and a lower portion, wherein said side wall is provided at said lower portion with an end portion folded back over itself towards the inside, to define an internal shoulder for retaining said tabs, wherein said side wall is provided with a smaller thickness at said lower portion than at said upper portion, wherein said internal shoulder has a height between 0.05 and 0.40 mm, and wherein said side wall is provided with three differentiated thicknesses: a first thickness at said upper portion, a second thickness at an intermediate portion of said side wall of said lower portion adjacent said upper portion, the second thickness being smaller than the first thickness, a third thickness at said end portion of said side wall folded back towards the inside, said third thickness being smaller than said second thickness.

4. A cap for a bottle stopping device, said device comprising a main body member and said cap, said cap being adapted to be mounted on said main body member and thereby defining a mounted position, said main body member having retaining tabs, said cap having a side wall for pressing said tabs against a neck of a bottle in said mounted position, said side wall having an upper portion and a lower portion, wherein said side wall is provided at said lower portion with an end portion folded back over itself towards the inside, in such a way as to define an internal shoulder for retaining said tabs, wherein said side wall is provided with a smaller thickness at said lower portion than at said upper portion, wherein said shoulder has a height comprised between 0.05 and 0.40 mm, wherein the cap is provided with a recess adjacent said shoulder, and wherein said side wall is provided with three differentiated thicknesses: a first thickness at said upper portion, a second thickness at an intermediate portion of said side wall of said lower portion adjacent said upper portion, the second thickness being smaller than the first thickness, a third thickness at said end portion of said side wall folded back towards the inside, said third thickness being smaller than said second thickness.

5. A cap for a bottle stopping device, said device comprising a main body member and said cap, said cap being adapted to be mounted on said main body member and thereby defining a mounted position, said main body member having retaining tabs, said cap having a side wall for pressing said tabs against a neck of a bottle in said mounted position, said side wall having an upper portion and a lower portion, wherein said side wall is provided at said lower portion with an end portion folded back over itself towards the inside, in such a way as to define an internal shoulder for retaining said tabs, wherein said side wall is provided with a smaller thickness as said lower portion than at said upper portion, wherein said shoulder has a height between 0.05 and 0.40 mm, wherein the cap is provided with a recess adjacent said shoulder, wherein the recess is formed by leaving a free space between said upper portion and the folded free end of said lower portion, and wherein said side wall is provided with three differentiated thicknesses: a first thickness at said upper portion, a second thickness at an intermediate portion of said side wall of said lower portion adjacent said upper portion, the second thickness being smaller than the first thickness, a third thickness at said end portion of said side wall folded back towards the inside, said third thickness being smaller than said second thickness.

* * * * *